US005775751A

United States Patent [19]

Nelson

[11] Patent Number: 5,775,751

[45] Date of Patent: Jul. 7, 1998

[54] BALL RETRIEVAL, STORAGE AND DISCHARGE DEVICE

[76] Inventor: Ryan L. Nelson, 1633 E. Lakeside Dr. #186, Gilbert, Ariz. 85234

[21] Appl. No.: 920,970

[22] Filed: Aug. 29, 1997

[51] Int. Cl.[6] ..... A63B 47/02

[52] U.S. Cl. ..... 294/19.2; 206/315.9; 221/297

[58] Field of Search ..... 294/19.1, 19.2, 294/82.28; 221/303, 304, 297; 206/315.9; 56/332; 224/919; 473/286

[56] References Cited

U.S. PATENT DOCUMENTS

| | | | |
|---|---|---|---|
| 713,672 | 11/1902 | Oliver . | |
| 2,027,546 | 1/1936 | McDonald . | |
| 2,760,807 | 8/1956 | Watson . | |
| 3,186,593 | 6/1965 | Miotke | 294/19.2 |
| 3,680,906 | 8/1972 | Neumeier | 294/82.28 |
| 4,045,068 | 8/1977 | Nelson . | |
| 4,058,336 | 11/1977 | Parkinson . | |
| 4,522,438 | 6/1985 | Logue . | |
| 5,395,146 | 3/1995 | Liu et al. . | |
| 5,466,027 | 11/1995 | Hockey . | |
| 5,476,297 | 12/1995 | Lombard | 294/19.2 |

*Primary Examiner*—Dean Kramer

*Attorney, Agent, or Firm*—Parsons & Goltry; Robert A. Parsons; Michael W. Goltry

[57] ABSTRACT

A retrieval, storage and discharge device including an inner cylindrical tube having a lower end, an upper end, an outer diameter, and an inner diameter sufficient to receive the balls, an outer cylindrical tube having a lower end, an upper end, an outer diameter, and an inner diameter sufficient to receive the outer diameter of the inner cylindrical tube, circumferentially spaced biased members carried in apertures formed through the lower end of the inner tube, and a collar mounted on the lower end of the outer cylindrical tube having an inner surface with greater diameters and lesser diameters, the collar rotatable with respect to the inner tube between a storage position wherein the biased members are aligned with and urged inward by the lesser diameter of the collar and a discharge position wherein the biased members are aligned with the greater diameter, and therefore permitted to move outwardly.

15 Claims, 3 Drawing Sheets

1
20
21
17
14
10

21
20
10
15
12
19
15
12
19
16
13
18
1

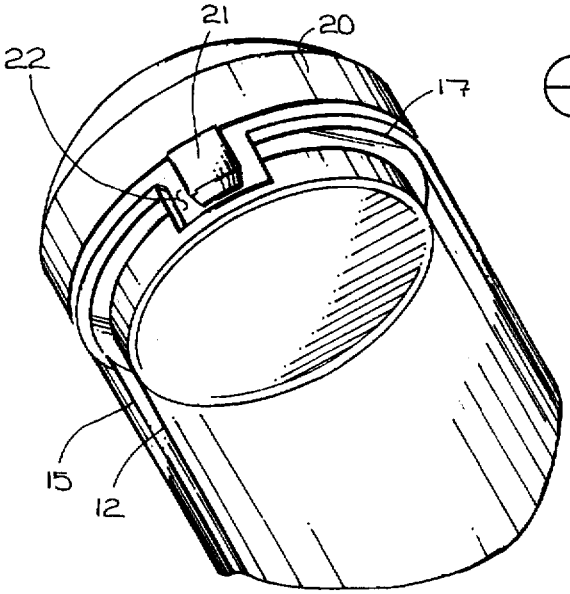
FIG. 3
FIG. 5(a)
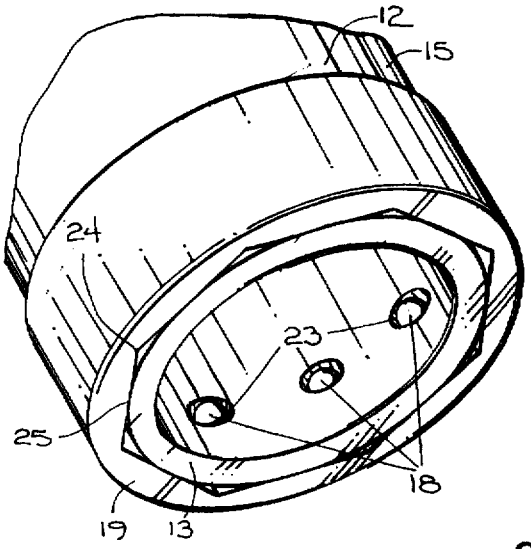
FIG. 4
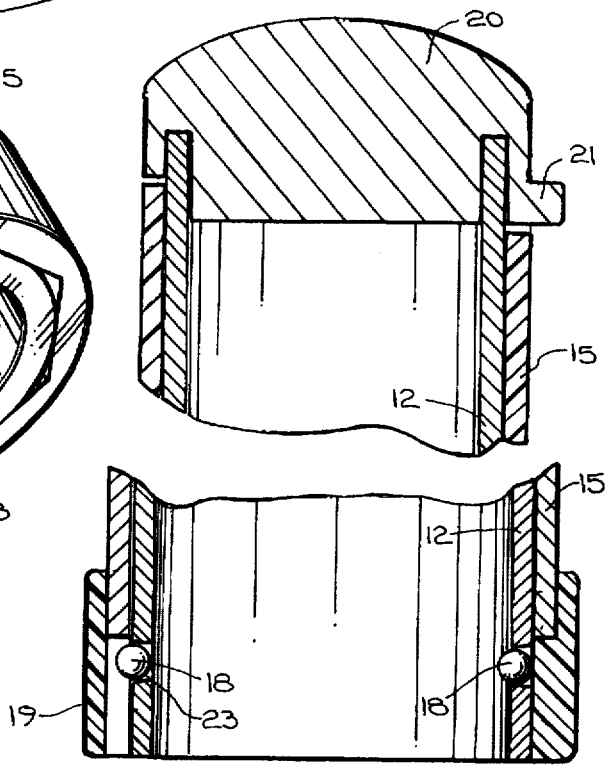
FIG. 5(b)

BALL RETRIEVAL, STORAGE AND DISCHARGE DEVICE

FIELD OF THE INVENTION

This invention relates to a device for retrieval, storage and discharge of balls.

More particularly, the present invention relates to a device for easy retrieval, storage and discharge of a multiplicity of golf balls without the necessity of applying substantial force, bending over, stooping, or inverting said device.

BACKGROUND OF THE INVENTION

In practicing ball games, such as golf, it is commonplace to use a multiplicity of balls, for example for performing a succession of practice strokes. Picking up said golf balls requires a considerable amount of bending over or stooping which is time consuming, and further, hard on the spine and the back muscles.

Prior art describes various types of devices to retrieve and store balls. Such devices usually consist of a cylindrical tube of plastics materials wherein said cylindrical tube is substantially circular in cross section and adapted to the size of the balls it is intended to be used with. For such known devices to be of practical utility they have to be of an appropriate length such that they hold an appropriate number of balls. For golfing use, they are of such a length as to be able to hold a minimum of twenty golf balls. Some of the previously proposed devices simply retrieve one ball, others require inverting the device to discharge the balls. Many of the earlier proposed ball retrieval devices use flexible, elastic or resilient collars, fingers, or lips, said flexible, elastic, or resilient parts being yieldable for the passage of the ball and engageable therebeneath for retaining said balls in the cylindrical tube. However, a multiplicity of stored golf balls have a considerable weight and accordingly, said resilient parts have to exert substantial force to prevent unintentional discharge of the cylindrical tube. In turn, substantial force needs to be applied by the user when retrieving a ball by forcing it inwards beyond said flexible, elastic, or resilient parts. As a consequence, such devices are not easy to use. Prior art also describes a retrieving device obviating said requirement of substantial force to be applied when retrieving a ball, however, said retrieval device is relatively complex in construction and does not elude the necessity to bend down or stoop when discharging the device.

It would be highly advantageous, therefore, to remedy the foregoing and other deficiencies inherent in the prior art.

Accordingly, it is an object of the present invention to provide an improved ball retrieval, storage, and discharge device.

It is another object of the present invention to provide an improved retrieval, storage, and discharge device for golf balls.

It is still another object of the present invention to provide an improved retrieval, storage, and discharge device for balls wherein retrieval and discharge of balls does not require bending over or stooping.

It is yet another object of the present invention to provide an improved retrieval, storage, and discharge device for balls wherein retrieval of a ball does not require substantial force to be applied by the user when retrieving a ball.

It is a further object of the present invention to provide an improved retrieval, storage, and discharge device for balls wherein the need to invert the device when discharging the balls is obviated.

It is still a further object of the present invention to provide an improved retrieval, storage, and discharge device for balls which is simple in construction, strong, durable, compact and light in weight.

It is yet a further object of the present invention to provide an improved retrieval, storage, and discharge device for balls which is highly efficient and reliable in use.

It is still a further object of the present invention to provide an improved retrieval, storage, and discharge device for balls which may be manufactured at low cost.

SUMMARY OF THE INVENTION

The above problems and others are at least partially solved and the above purposes and others are realized in a ball retrieval, storage and discharge device including an inner cylindrical tube having a lower end, an upper end, an outer diameter, and an inner diameter sufficient to receive the balls, an outer cylindrical tube having a lower end, an upper end, an outer diameter, and an inner diameter sufficient to receive the outer diameter of the inner cylindrical tube, circumferentially spaced biased members carried in apertures formed through the lower end of the inner tube, and a collar mounted on the lower end of the outer cylindrical tube having an inner surface with greater diameters and lesser diameters, the collar rotatable with respect to the inner tube between a storage position wherein the biased members are aligned with and urged inward by the lesser diameter of the collar and a discharge position wherein the biased members are aligned with the greater diameter, and therefore permitted to move outwardly.

In accordance with a further embodiment, ball retrieval, storage and discharge device further includes a cap having a knob extending therefrom, coupled to and closing the upper end of the inner tube, and rotatable with respect to the outer tube. A notch is formed in the upper end of the outer tube to receive the knob and aid in aligning the collar with the biasing members in the storage and discharge positions.

BRIEF DESCRIPTION OF THE DRAWINGS

The foregoing and further and more specific objects and advantages of the invention will become readily apparent to those skilled in the art from the following detailed description of a preferred embodiment thereof taken in conjunction with the drawings, in which:

FIG. 3 is a detail view in perspective of the upper end of the ball retrieval, storage, and discharge device in accordance with the invention;

FIG. 4 is a detail view in perspective of the lower end of the ball retrieval, storage, and discharge device in accordance with the invention;

FIGS. 5(*a* & *b*) is a detail view in cross section being primarily taken on the line 1—1 of FIG. 1 of (a) the upper end and (b) the lower end of the ball retrieval, storage, and discharge device in accordance with the invention.

DESCRIPTION OF THE PREFERRED EMBODIMENT

Figures 1, 2:
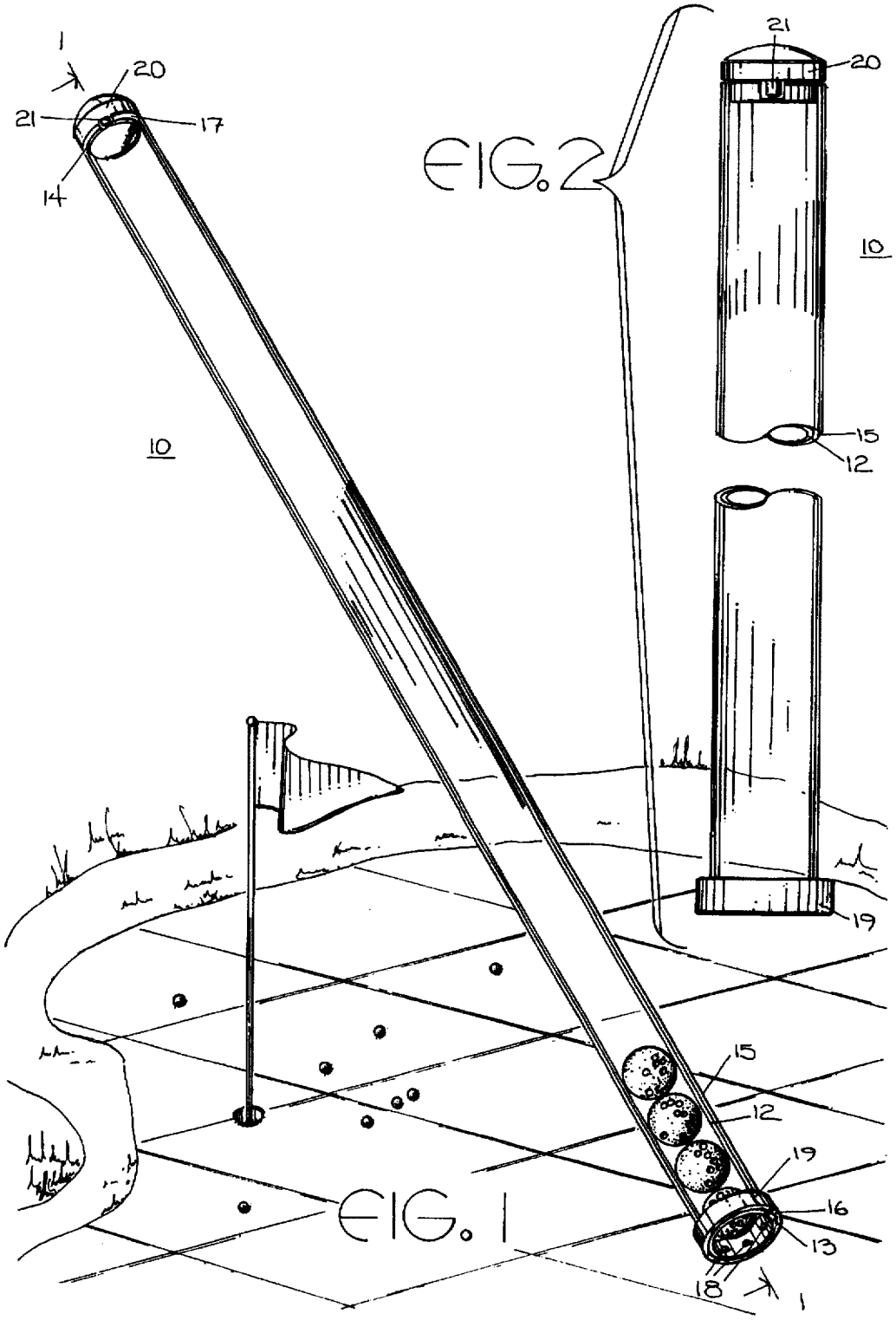
FIG. 1 is a perspective view of the ball retrieval, storage, and discharge device in accordance with the invention.
FIG. 2 is an elevational view partially in cross section of the ball retrieval, storage, and discharge device in accordance with the invention.

Turning now to the drawings in which like reference characters indicate corresponding elements throughout the several views, attention is first directed to FIG. 1 which shows a perspective view of a ball retrieval, storage, and discharge device generally designated 10. Device 10 includes an inner cylindrical tube 12 with an outer diameter and an inner diameter sufficient to receive golf balls, having a lower end 13 and an upper end 14. Also included is an outer cylindrical tube 15 having an outer diameter and an inner diameter sufficient to receive the outer diameter of inner cylindrical tube 12, having a lower end 16 and an upper end 17. Circumferentially spaced spheres 18 are carried in tapered apertures on lower end 13 of inner tube 12. It will be understood that while spheres 18 are employed in the preferred embodiment, other biased members can be employed such as wedges ovals etc. The biasing of the biased members will be described presently. A collar 19 is mounted on lower end 16 of outer cylindrical tube 15 and has an inner surface with greater diameters and lesser diameters. In the preferred embodiment, the inner surface has a shape of an equilateral polygon, and actuating means such as a cap 20 and a knob 21 coupled to and closing the upper end 14 of inner cylindrical tube 12 for rotating inner cylindrical tube 12 relative to outer cylindrical tube 15 along their common longitudinal axis. Thus, easy ball retrieval and discharge (discharge position) as well as ball retainment (storage position) are accomplished by rotating inner cylindrical tube 12 with respect to outer cylindrical tube 15. Unintentional rotation of inner tube 12 relative to outer tube 15 which may cause, for example, an accidental discharge of balls from device 10, is avoided by an appropriate friction force between inner tube 12 and outer tube 15 or elements associated therewith such as cap 20 or collar 19. The following drawings further illustrate ball retrieval (retrieval position), discharge (discharge position), and ball storage (storage position).

Referring now to FIG. 2, an elevational view partially in cross section of the ball retrieval, storage, and discharge device 10 in accordance with the present invention is shown. FIG. 2 specifically illustrates the use of inner cylindrical tube 12 and outer cylindrical tube 15 in the construction of the device according to the present invention. The advantages of using inner cylindrical tube 12 and outer cylindrical tube 15 will become readily apparent to those skilled in the art from the following detailed descriptions of the operation and use of ball retrieval, storage, and discharge device 10.

Turning now to FIG. 3, a detail view in perspective of the upper end of ball retrieval, storage, and discharge device 10 in accordance with the invention is shown. A notch 22 is cut into upper end 17 of outer cylindrical tube 15 to accommodate knob 21 thereby allowing restricted rotation of inner cylindrical tube 12 relative to outer cylindrical tube 15 along their common longitudinal axis and aid in aligning collar 19 with biasing members to achieve the storage and discharge positions. Further, FIG. 4 is a detail view in perspective of the lower end of ball retrieval, storage, and discharge device 10 in accordance with the invention, having a plurality of generally equally spaced, radially disposed and inwardly tapered apertures 23 formed in lower end 13 of inner tube 12, collar 19 having an inner shape of an equilateral polygon with interior angles 24 (greater diameter) and interior sides 25 (lesser diameter), and spheres 18 (biased members) carried in apertures 23. Spheres 18 are positioned against the interior of collar 19 and the number of the angles, sides, and spheres is identical. FIG. 4 illustrates the case of ball discharge (discharge position) wherein spheres 18 are aligned with and positioned in interior angles 24 of collar 19. It will be understood that substantially any shape can be employed for the inner surface of collar 19, as long as there are a plurality of greater and lesser diameters associated with each of spheres 18. In the present embodiment, the greater diameters correspond to interior angles 24. When interior angles 24 are aligned with spheres 18, the weight exercised by the stored balls forces spheres 18 outward to clear the interior of inner cylindrical tube 12. This is made possible by the greater diameter of interior angles 24.

In a specific embodiment, the discharge position shown in FIG. 4 is used also for ball retrieval (retrieval position) wherein the force applied by a ball when being retrieved causes spheres 18 to move into interior angles 24, clearing the interior of inner cylindrical tube 12 as will be explained in detail in FIGS. 6 (*a*)–(*c*). In another embodiment, ball retrieval is accomplished using the storage position of the ball retrieval, storage, and discharge device as will be further explained in the following.

Turning now to FIG. 5, a detail view in cross section being primarily taken on the line 1—1 of FIG. 1 of (a) the upper end and (b) the lower end of ball retrieval, storage, and discharge device 10 in accordance with the invention is shown. FIG. 5 (*b*) illustrates both the position of ball discharge wherein spheres 18 clear the interior of inner tube 12 (left side), and ball storage wherein spheres 18 are biased inwardly by the lesser diameter and obstruct the interior of inner tube 12 (right side). In storage position, the lowest ball rests on spheres 18 which are positioned against interior sides 25 (lesser diameter) of collar 19 thereby firmly obstructing the interior of inner tube 12. As addressed before, ball retrieval could also be exercised in storage position provided that collar 19 is made of a resilient material such that the force applied by a ball during retrieval is sufficient to cause spheres 18 to clear the interior of tube 12, but the weight exercised by the maximum number of balls to be stored is insufficient to force spheres 18 to clear the interior of inner cylindrical tube 12. It will of course be understood, that FIG. 5 shows the position of ball retrieval and storage for the purpose of illustration only; both positions do not occur simultaneously at any one time.

Figure 6A:
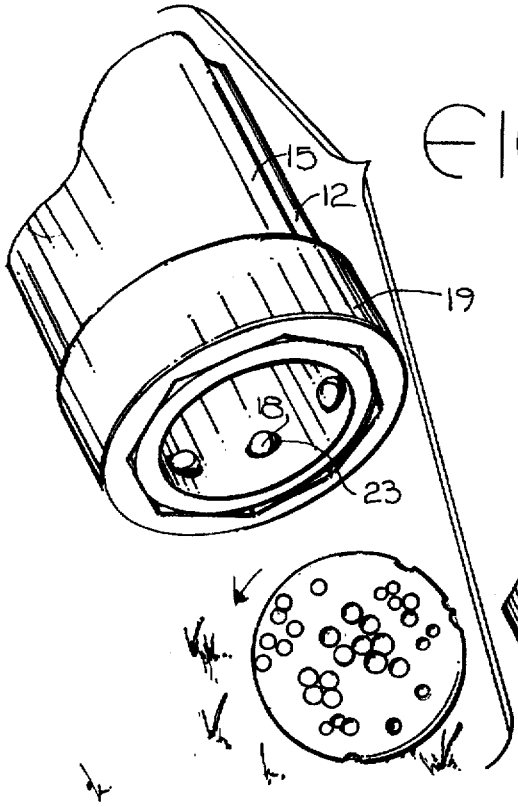
FIGS. 6(*a*–*c*) is a detail view in perspective of the lower end of the ball retrieval, storage, and discharge device in accordance with the invention in use, (a) when approaching a ball to be retrieved, (b) when positioning the spheres clear of the interior of the inner cylindrical tube by rotating the inner cylindrical tube relative to the outer cylindrical tube along their common longitudinal axis, and (c) when a ball is entering the inner cylindrical tube.
Figure 6B:
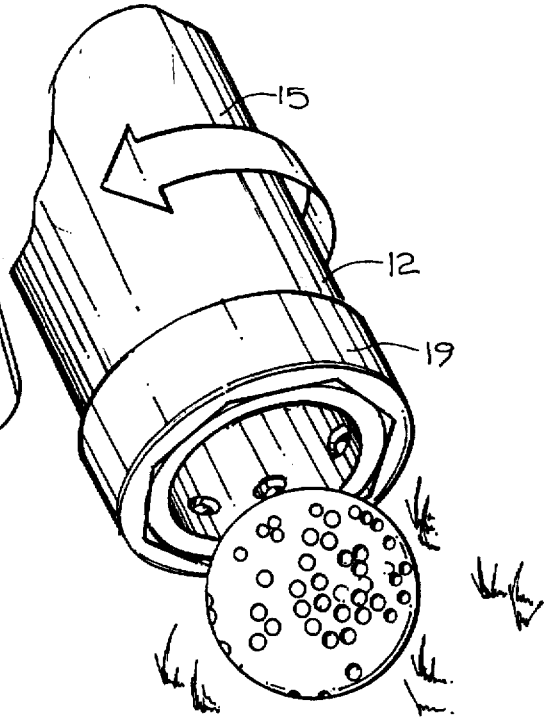
Figure 6C:
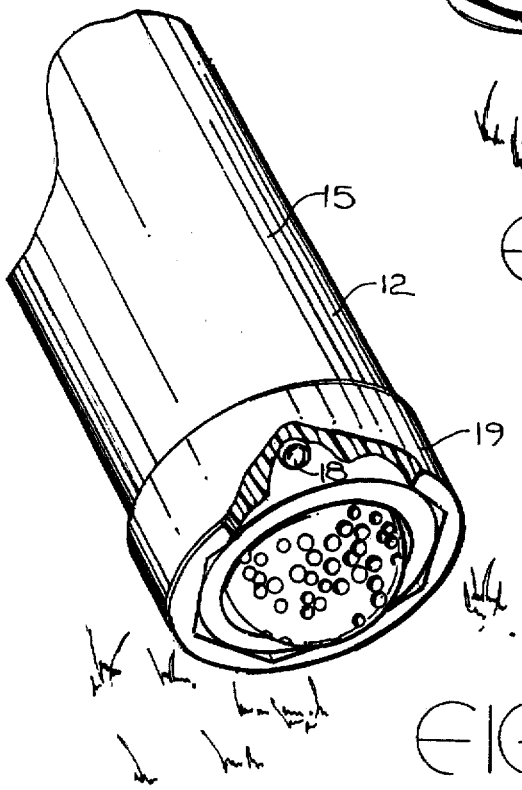

Turning now to FIG. 6, ball retrieval is illustrated in detail in perspective of the lower end of ball retrieval, storage, and discharge device 10 wherein (a) the ball to be retrieved is approached (storage position), (b) inner cylindrical tube 12 is rotated relative to outer cylindrical tube 15 along their common longitudinal axis and spheres 18 are ready to clear the interior of inner cylindrical tube 12 (switching from storage to retrieval position), and (c) the ball is entering inner cylindrical tube 12 (retrieval position).

Various changes and modifications to the embodiments herein chosen for the purposes of illustration will readily occur to those skilled in the art. For example, while golf balls are illustrated as the objects being retrieved and stored in the present invention, it will be understood that the invention can be constructed so as to accommodate other types of balls such as tennis balls, base balls, etc. To the extent that such modifications and variations do not depart from the spirit of the invention, they are intended to be included within the scope thereof which is assessed only by a fair interpretation of the following claims.

Having fully described the invention in such clear and concise term as to enable those skilled in the art to understand and practice the same, the invention claimed is:

1. A retrieval, storage and discharge device for a multiplicity of balls comprising:

an inner cylindrical tube having a lower end, an upper end, an outer diameter, and an inner diameter sufficient to receive the balls;

an outer cylindrical tube having a lower end, an upper end, an outer diameter, and an inner diameter sufficient to receive the outer diameter of the inner cylindrical tube;

circumferentially spaced biased members carried in apertures formed through the lower end of the inner tube;

a collar mounted on the lower end of the outer cylindrical tube having an inner surface with greater diameters and lesser diameters, the collar rotatable with respect to the inner tube between a storage position wherein the biased members are aligned with and urged inward by the lesser diameter of the collar and a discharge position wherein the biased members are aligned with the greater diameter, and therefore permitted to move outwardly.

2. A ball retrieval, storage and discharge device as claimed in claim 1 wherein the inner surface of the collar is an equilateral polygon with interior angles and interior sides and the biased members include spheres.

3. A ball retrieval, storage and discharge device as claimed in claim 2 wherein the ball discharge position is adjusted by positioning the spheres in interior angles of the collar and the weight exercised by the stored balls forces the spheres to clear the interior of inner cylindrical tube.

4. A ball retrieval, storage and discharge device as claimed in claim 2 wherein a ball retrieval position is achieved by positioning the spheres in interior angles of the collar and the force applied by a ball when being retrieved causes the spheres to clear the interior of the inner cylindrical tube.

5. A ball retrieval, storage and discharge device as claimed in claim 2 wherein the ball storage position is adjusted by positioning the spheres against the interior sides of the collar thereby firmly obstructing the interior of inner tube with the lowest ball resting on the spheres.

6. A ball retrieval, storage and discharge device as claimed in claim 1 wherein unintentional switching between storage and discharge position is obviated by an appropriate friction force between the inner and outer cylindrical tube.

7. A ball retrieval, storage and discharge device as claimed in claim 1 wherein further including a cap having a knob extending therefrom, coupled to and closing the upper end of the inner tube, and rotatable with respect to the outer tube.

8. A ball retrieval, storage and discharge device as claimed in claim 7 further including a notch formed in the upper end of the outer tube to receive the knob and aid in aligning the collar with the biasing members in the storage and discharge positions.

9. A retrieval, storage and discharge device for a multiplicity of balls comprising:

an inner cylindrical tube having a lower end, an upper end, an outer diameter, and an inner diameter sufficient to receive the balls;

an outer cylindrical tube having a lower end, an upper end, an outer diameter, and an inner diameter sufficient to receive the outer diameter of the inner cylindrical tube;

circumferentially spaced biasing members carried in tapered apertures formed through the lower end of the inner tube;

a collar made of a resilient material wherein said collar is mounted on the lower end of the outer cylindrical tube having an inner surface with greater diameters and lesser diameters; and actuating means for rotating the inner cylindrical tube relative to the outer cylindrical tube along their common longitudinal axis between a storage position wherein the biased members are aligned with and urged inward by the lesser diameter of the collar and a discharge position wherein the biased members are aligned with the greater diameter, and therefore permitted to move outwardly.

10. A ball retrieval, storage and discharge device as claimed in claim 9 wherein the inner surface of the collar is an equilateral polygon with interior angles and interior sides and the biased members include spheres.

11. A ball retrieval, storage and discharge device as claimed in claim 10 wherein the ball discharge position is adjusted by positioning the spheres in interior angles of the collar and the weight exercised by the stored balls forces the spheres to clear the interior of inner cylindrical tube.

12. A ball retrieval, storage and discharge device as claimed in claim 10 wherein the ball retrieval position is achieved by positioning the spheres against the interior sides of the resilient collar and the force applied by a ball during retrieval is sufficient to cause the spheres to distort the resilient collar and clear the interior of inner cylindrical tube.

13. A ball retrieval, storage and discharge device as claimed in claim 10 wherein the ball storage position is adjusted by positioning the spheres against the interior sides of collar and the weight exercised by the maximum number of balls to be stored is insufficient to distort the resilient collar and force said spheres to clear the interior of inner cylindrical tube thereby firmly obstructing the interior of inner tube with the lowest ball resting on the spheres.

14. A ball retrieval, storage and discharge device as claimed in claim 9 wherein the actuating means includes a cap having a knob extending therefrom, coupled to and closing the end of the inner tube, and rotatable with respect to the outer tube.

15. A ball retrieval, storage and discharge device as claimed in claim 14 wherein the actuating means further includes a notch formed in the end of the outer tube to receive the knob and aid in aligning the collar with the biasing members in the storage and discharge positions.

* * * * *